United States Patent [19]

Golan

[11] 4,422,250

[45] Dec. 27, 1983

[54] EMBROIDERY HOOP

[76] Inventor: Dan Golan, 165 W. 66 St., New York, N.Y. 10023

[21] Appl. No.: 397,600

[22] Filed: Jul. 12, 1982

[51] Int. Cl.[3] ..... D05C 1/04; D06C 3/08

[52] U.S. Cl. ..... 38/102.2

[58] Field of Search ..... 38/102.2; 160/378, 380; 285/420; 24/19, 20 SL, 20 W, 20 R, 279

[56] References Cited

U.S. PATENT DOCUMENTS

| | | | |
|---|---|---|---|
| 374,623 | 12/1887 | Pease | 38/102.2 |
| 1,242,972 | 10/1917 | Pettit | 38/102.2 |
| 1,412,019 | 4/1922 | Ploch | 38/102.2 |
| 3,526,933 | 9/1970 | Parr | 285/420 |
| 4,010,562 | 3/1977 | Maier | 38/102.2 |

FOREIGN PATENT DOCUMENTS

| | | | |
|---|---|---|---|
| 659410 | 6/1929 | France | 38/102.2 |
| 19887 | of 1913 | United Kingdom | 38/102.2 |

*Primary Examiner*—Werner H. Schroeder
*Assistant Examiner*—Andrew M. Falik
*Attorney, Agent, or Firm*—Stephen E. Feldman

[57] ABSTRACT

A spring-type embroidery hoop or knitting ring includes a plastic annular member with an interiorly-grooved surface, a spring-loaded member that fits securely with the free ends of said spring-loaded member projecting radially outwardly, and a locking member that restrains the free ends of the spring-loaded member from separating from one another more than a fixed spacing distance. A squeezing manipulation of the free ends causes them to be spaced from each other a distance less than the fixed spacing distance, while concomitantly reducing the circumferential dimension of the inner ring, so that the inner ring may be moved in or out of the groove in the outer ring in a controlled manner.

10 Claims, 10 Drawing Figures

EMBROIDERY HOOP

BACKGROUND OF THE INVENTION

1. Field of the Invention

Spring-type embroidery hoops or knitting rings also usable for sewing machine work, e.g. schifling.

2. Description of the Prior Art

Embroidery hoops, otherwise known and used as knitting rings, are devices and articles of manufacture which have been known and used both in the home and in factories for many years. Spring-type embroidery hoops or knitting rings are known and used both for hand and machine work. One advantage of the spring-type device is that there is no screw to tighten, and no need for a screw, since the mounting of the cloth, etc., in the device is accomplished by the spring action. These spring-type devices are usually provided with convenient grips to guide the work, and are ideal for embroidery, counted cross-stitch monograms, crewel, etc. Basically, to use the spring-type device, the material (cloth) is placed on the outer plastic ring. The metal spring ring is placed on top, pressed or squeezed, and locked into place in the groove in the outer plastic ring. Other types of embroidery hoops are known, such as the large, wooden, oval- or elliptical-shaped units provided with an outer screw for tightening the outer wooden ring against the inner wooden ring. Among the prior art relative to embroidery hoops, knitting rings, and the like may be mentioned U.S. Pat. Nos. 3,906,647; 1,242,972; and 1,072,687.

SUMMARY OF THE INVENTION

1. Purposes of the Invention

It is an object of the present invention to provide an improved spring-type embroidery hoop or knitting ring.

Another object is to provide such a device and article of manufacture to be used as a frame, if so desired, by using a hanging device.

Another object is to provide such a device and article of manufacture in which a restraining means is provided, the restraining means extending between the two fingers of the inner (metal) ring so as to curtail and prevent excessive lateral displacement of the two fingers away from each other or beyond and greater than a fixed spacing distance.

A further object is to provide such a device and article of manufacture in which the restraining means, which extends between the two fingers of the inner ring, permits lateral movement and displacement of the two fingers towards each other, so that squeezing manipulation of the two fingers causes the two fingers to be spaced from each other a distance less than the fixed spacing distance, while concomitantly reducing the circumferential dimension of the inner ring, so that the inner ring may be moved in or out of the groove in the outer ring.

An additional object is to provide such a device and article of manufacture which may be more readily and easily manipulated and used.

Still another object is to provide such a device and article of manufacture in which excessive stress on the outer ring is prevented.

Still a further object is to provide such a device and article of manufacture which is simpler and easier to use than prior art devices.

Still an additional object is to provide such a device and article which lasts longer and does not wear out or weaken so readily in service.

An object is to provide such a device and article which may be more readily manipulated and adjusted than prior art devices.

These and other objects and advantages of the present invention will become evident from the description which follows.

2. Brief Description of the Invention

The present invention is directed to the field of art of devices and articles of manufacture known as spring-type embroidery hoops or knitting rings, the new device and article of manufacture constituting an improvement in the specific field of such spring-type embroidery hoops or knitting rings. In one embodiment, the device includes a plastic annular member with an interiorly-grooved surface, a spring-loaded member that fits securely therewithin, the free ends of said spring-loaded member projecting radially outwardly therefrom, and the invention being characterized by a slotted member that restrains the free ends of the spring-loaded member from separating from one another. One of the free ends of the spring-loaded member rides in the slot of the locking member or clip, and is thus guided in its lateral movement, especially relative to the other free end or finger.

In an alternative embodiment of the present invention, the aforementioned restraining means is a length of a flexible linear connection means such as a chain, a cable, a wire, a cord, a string or the like. In one preferred embodiment, the length of flexible linear connection means is a metal chain, with each end link of the metal chain being permanently attached to one of the fingers by welding or the like. In another alternative preferred embodiment, the length of flexible linear connection means is also a chain, and each of the fingers has a transverse opening therethrough. In this case, each end link of the chain extends through the opening in one of the fingers.

The invention accordingly consists in the features of construction, combination of elements and arrangement of parts which will be exemplified in the device and article of manufacture hereinafter described, and of which the scope of application is as eludicated supra and as will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
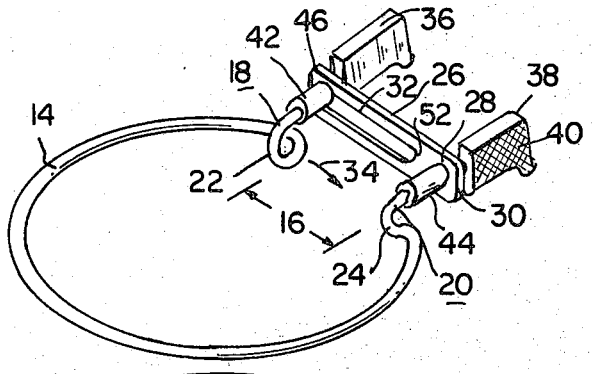
FIG. 1 is an exploded perspective view of the present embroidery hoop or knitting ring, showing the outer and inner rings separated.

Referring now to FIG. 1, the present spring-type embroidery hoop or knitting ring article or device includes an outer, circular, plastic ring 10 having an inner groove 12 and an inner, circular, springy, metal ring 14, which are concentrically oriented. Referring to the inner ring 14, a gap at 16 is provided in the continuity of the ring 14, and two fingers 18 and 20 form extensions of the ring 14 and extend generally radially outwards from the ring 14, via respective curved attachments 22 and 24. A restraining means consisting of a clip 26 extends between the fingers 18 and 20. The clip 26 in this embodiment of the invention is characterized by the provision of a hole or opening 28 at one end 30, through which the finger 20 extends, so that the clip 26 can freely pivot about the finger 20, and an axial slot 32 through which the finger 18 extends, so that the finger 18 is slidably movable along the sot 32, when the fingers 18 and 20 are manipulated by squeezing towards each other, as shown by the arrow 34.

A pair of terminal gripping means 36, 38, consisting of plastic fittings for manual grasping of the fingers 18 and 20 by the human fingers of the user, are provided at the terminal ends of the fingers 18, 20, with each finger 18 or 20 having its respective fitting 36 or 38 mounted as shown. A laterally-knurled outer surface, e.g. surface 40 of fitting 38, will usually be provided in practice to facilitate the manual grasping of the terminal plastic fittings 36, 38 by the user. In addition, each finger 18, 20 is preferably provided with its own individual respective outer flexible resilient plastic sleeve 42, 44. Each sleeve 42, 44 extends along its respective finger 18, 20 from the restraining means (slotted clip 26), and towards the inner ring 14, terminating proximately at the respective curved attachment 22, 24. Thus the restraining means consisting in this case of clip element 26 is prevented from slippage and displacement towards the inner ring 14.

Figure 2:
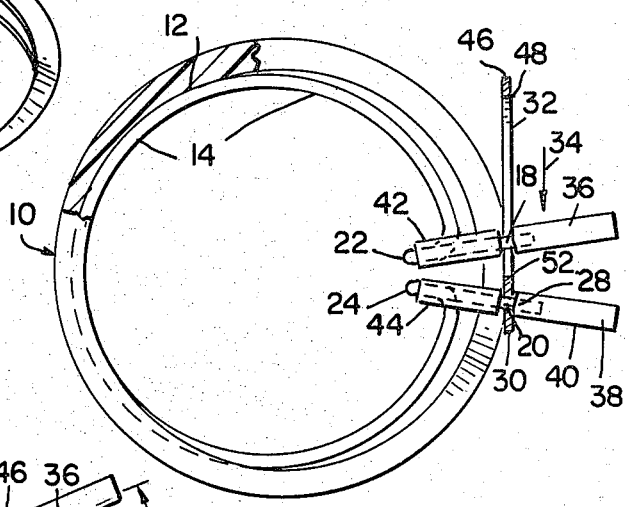
FIG. 2 is a plan view of the assembled ring, showing the inner ring nesting in a groove in the outer ring.

FIG. 2 shows the normal disposition of the elements in service, with ring 14 being extended and nesting in the groove 12 in ring 10. Excessive outwards pressure of ring 14 against ring 10 is prevented and curtailed by the restraining means 26, with finger 18 engaging the closed end 46 of clip 26 at the outer end 48 of the slot 32.

Figure 3:
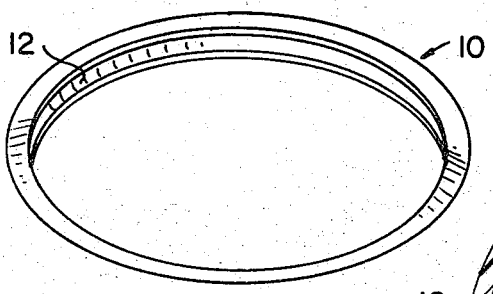
FIG. 3 shows how squeezing manipulation of the fingers tends to distort and constrict the inner ring to a smaller circumference so that it separates from the outer ring.
Figure 5:
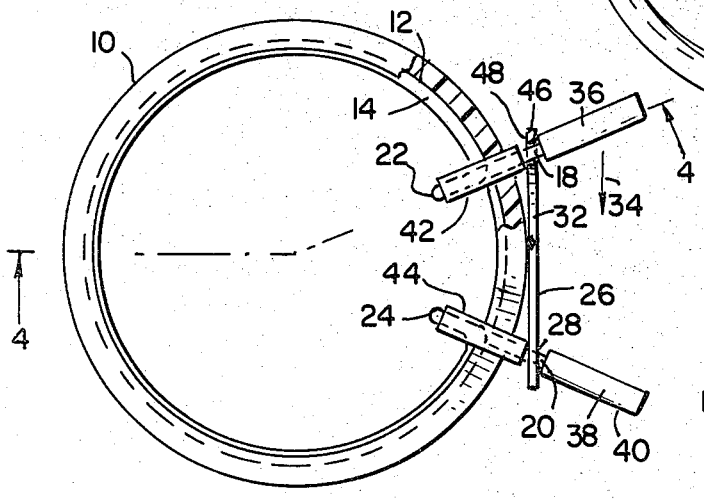
FIG. 5 shows the article and device with cloth, fabric or other textile in place, in sectional elevation view.
Figure 5:
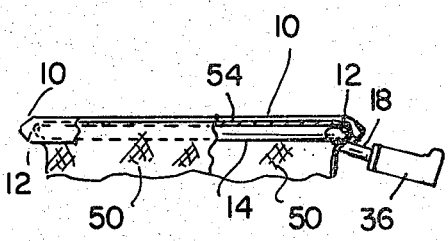

FIG. 3 shows the disposition of the elements when the material being worked, e.g. cloth, fabric or the like textile such as 50, see FIG. 5, is to be either emplaced in position in the device, or removed from the device. In FIG. 3 the ring 14 is retracted, i.e. by squeezing manipulation of the fittings 36, 38, the finger 18 has been slid along in slot 32, as shown by arrow 34, away from slot end 48 at clip end 46, and into juxtaposition with the other slot end 52 adjacent hole or opening 28 in the clip 26. This manipulation has resulted in a decreasing or diminishing of the effective circumference of the inner ring 14, so that its effective perimetral dimension has been diminished, and so that the inner ring 14 is now smaller, and out of the groove 12, and is no longer contiguous with the outer ring 10. Thus, any textile or other material 50 may readily be emplaced into the device, or removed therefrom if previously emplaced, all as mentioned supra.

Figure 4:
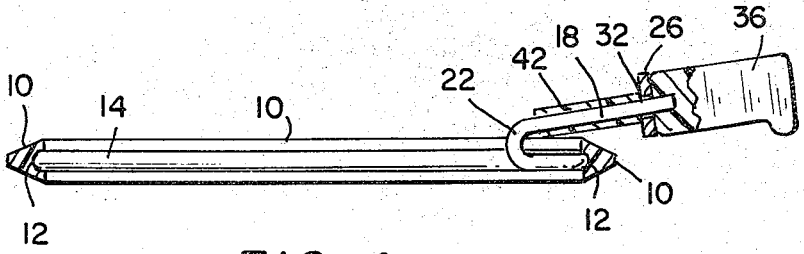
FIG. 4 is a sectional elevation view taken substantially along the line 4—4 of FIG. 2 and showing the orientation of the several elements as assembled in place.

FIG. 4 shows details of the configuration, and FIG. 5 shows emplaced cloth, fabric, textile material or the like in the device. The expansion of the inner ring 14 into the groove 12 and against the outer ring 10 effectively grips the emplaced cloth or the like, so that it is tautly stretched and may be worked, e.g. by embroidery or knitting, as desired. As shown, the cloth portion 54 extends flatly across the plane defined by the rings 10 and 14, and is firmly and flatly stretched and held in place for working.

Figure 6:
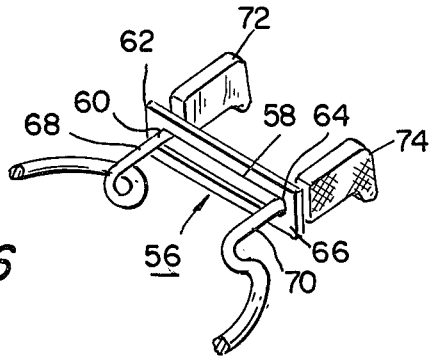
FIG. 6 shows an alternative embodiment, with both fingers in the slot in the clip.

FIG. 6 shows a clip 56 having an axial slot 58 which extends continuously and longitudinally from a terminus 60 adjacent one end 62 of the clip 56 to a terminus 64 adjacent the other end 66 of the clip 56. Both of the fingers 68 and 70 are disposed in the slot 58, so that both fingers 68 and 70 concomitantly move towards each other, and meet proximately at the middle of the slot 58, when the two fittings 72, 74 are squeezed, or otherwise manipulated, towards each other.

Figure 7:
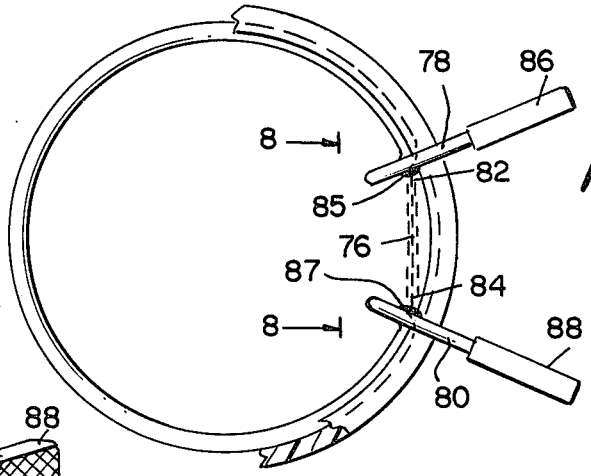
FIG. 7 shows an alternative embodiment in which the restraining means is a length of chain, each end link of the chain being welded to one of the fingers.
Figure 8:
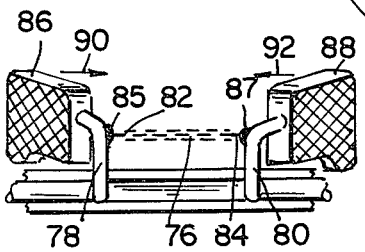
FIG. 8 is an end view of the FIG. 7 embodiment of the invention.

FIG. 7 shows a configuration in which the restraining means is a chain 76, the chain 76 extending between the fingers 78 and 80. Each end link 82 and 84 of the chain 76 is welded at 85 or 87 to the respective finger 78 or 80, as best seen in FIG. 8, which also shows how manipulation of the fittings 86 and 88 towards each other tend to move the opposed fingers 78 and 80 towards each other, as indicated by arrows 90 and 92.

Figure 9:
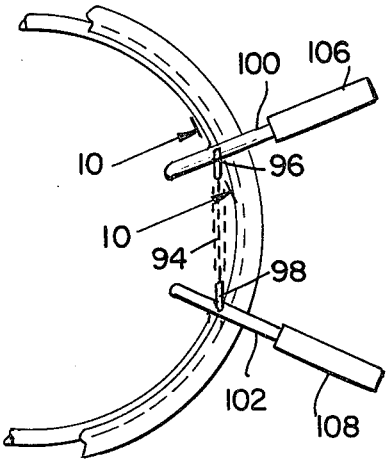
FIG. 9 shows an alternative embodiment in which each end link of the chain is mounted in and extends through a respective hole or opening in the respective finger.
Figure 10:
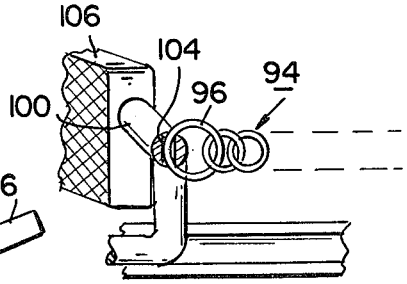
FIG. 10 is a detail of FIG. 9, showing the end link of the chain extending through the opening in the finger.

FIGS. 9 and 10 show an alternative embodiment of a chain 94 composed of a plurality of linked rings. Each enlarged end link 96, 98 is attached to its respective finger 100, 102 via being extended through a hole or opening in the respective finger, such as opening 104 in finger 100, see FIG. 10. The end fittings 106, 108 mounted to the ends of the respective fingers 100, 102 are manipulated as before.

The present device and article of manufacture, in addition to usage as a spring-type embroidery hoop or knitting ring, is also eminently suitable for usage in schifling or other sewing machine work, or as a frame if so desired by using a hanging device. The present device and article is amenable to home or factory usage, or for distribution for retail and industrial applications.

It thus will be seen that there is provided a spring-type embroidery hoop or knitting ring which achieves the various objects of the invention, and which is well adapted to meet the conditions of practical use.

As various possible embodiment might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A spring-type embroidery hoop or knitting ring comprising:

(a) an outer, circular, continuous, annular ring, said outer ring having an inner perimetral groove or the like in its inner surface;

(b) an inner circular ring, said inner ring having a gap and being composed of a springy material, so that said inner ring is resiliently deformable to a smaller generally circular shape than said outer ring, said inner ring being concentrically disposed within said outer ring, so that said inner ring nests in said groove;

(c) two spaced-apart fingers, each of said fingers extending generally radially outwards from said inner ring at one end of said gap; and (d) restraining means comprising a clip member, said means extending between said fingers to curtail and prevent excessive lateral displacement of said two fingers away from each other beyond and greater than a fixed spacing distance upon removal of the outer ring from the inner ring, while permitting lateral movement and displacement of said two fingers towards each other, so that squeezing manipulation of said two fingers causes said two fingers to be spaced from each other a distance less than said fixed spacing distance, while concomitantly reducing the circumferential dimension of said inner ring, so that said inner ring may be moved in or out of said groove.

2. The spring-type embroidery hoop or knitting ring of claim 1 in which the means of (d) is a generally rectilinear clip provided with an axial slot and a terminal opening at one end, one of said fingers extending through said slot, the other finger extending through said opening.

3. The spring-type embroidery hoop or knitting ring of claim 1 in which the means of (d) is a generally rectilinear clip provided with an axial slot, both of the spaced-apart fingers extending through the slot.

4. The spring-type embroidery hoop or knitting ring of claim 1 in which the means of (d) is a length of a flexible linear connection means wire, a cord, a string, or the like.

5. The spring-type embroidery hoop or knitting ring of claim 4 in which the length of flexible linear connection means is a metal chain, each end link of said metal chain being permanently attached to one of said fingers by welding or the like.

6. The spring-type embroidery hoop or knitting ring of claim 4 in which the length of flexible, linear, connection means is a chain, each of said fingers having a transverse opening therethrough, each end link of said chain extending through an opening in one of said fingers.

7. The spring-type embroidery hoop or knitting ring of claim 1 in which the outer ring is composed of a flexible resilient plastic.

8. The spring-type embroidery hoop or knitting ring of claim 1 in which the inner ring and two fingers are composed of a continuous linear length of a metalic material.

9. The spring-type embroidery hoop or knitting ring of claim 1 in which each finger is provided with an outer, flexible, resilient plastic sleeve, each sleeve extending along the finger from the restraining means and towards the inner ring, so that the restraining means is prevented from slippage and displacement towards the inner ring.

10. The spring-type embroidery hoop or knitting ring of claim 1 in which a terminal gripping means for manual grasping and having a laterally, outer-knurled surface is provided at the terminal end of each finger.

* * * * *